US010736185B2

(12) United States Patent
Carcano et al.

(10) Patent No.: US 10,736,185 B2
(45) Date of Patent: Aug. 4, 2020

(54) APPARATUS AND SYSTEM FOR AN OVEN SUPPORT STRUCTURE AND AIR FILTRATION ASSEMBLY

(71) Applicant: ILLINOIS TOOL WORKS INC., Glenview, IL (US)

(72) Inventors: Marco Carcano, Senago (IT); Michele Gentile, Jesi (IT); Michele Sclocchi, San Donato Milanese (IT)

(73) Assignee: ILLINOIS TOOL WORKS INC., Glenview, IL (US)

( * ) Notice: Subject to any disclaimer, the term of this patent is extended or adjusted under 35 U.S.C. 154(b) by 268 days.

(21) Appl. No.: 15/810,175

(22) Filed: Nov. 13, 2017

(65) Prior Publication Data

US 2018/0152997 A1 May 31, 2018

Related U.S. Application Data

(60) Provisional application No. 62/427,976, filed on Nov. 30, 2016.

(51) Int. Cl.

| | |
|---|---|
| ***H05B 6/64*** | (2006.01) |
| ***H05B 6/68*** | (2006.01) |
| ***H05B 6/66*** | (2006.01) |

(52) U.S. Cl.

CPC ..... *H05B 6/6473* (2013.01); *H05B 6/642* (2013.01); *H05B 6/6426* (2013.01); *H05B 6/664* (2013.01); *H05B 6/686* (2013.01)

(58) Field of Classification Search

CPC .... H05B 6/6473; H05B 6/6426; H05B 6/686; H05B 6/642; H05B 6/664; H05B 6/6476; H05B 6/6423; H05B 6/64

See application file for complete search history.

(56) References Cited

U.S. PATENT DOCUMENTS

| | | | | |
|---|---|---|---|---|
| 4,666,113 | A | 5/1987 | Itoh et al. | |
| 7,834,299 | B2 * | 11/2010 | Claesson | A21B 1/245 126/273 A |

(Continued)

FOREIGN PATENT DOCUMENTS

| | | | |
|---|---|---|---|
| EP | 2844034 | A1 | 3/2015 |
| WO | 2006065807 | A2 | 6/2006 |

OTHER PUBLICATIONS

International Search Report and Written Opinion of PCT/US2017/062187 dated Feb. 23, 2018, all enclosed pages cited.

*Primary Examiner* — David J Walczak
(74) *Attorney, Agent, or Firm* — Burr & Forman, LLP

(57) ABSTRACT

An air circulation system includes an inlet filter support structure, a first side filter and a second side filter. The air circulation system is for an oven that has a cooking chamber configured to receive a food product and a radio frequency (RF) heating system configured to provide RF energy into the cooking chamber using solid state electronic components. The air circulation system is configured to provide air for cooling the solid state electronic components. The inlet filter support structure enables cooling air for cooling the solid state electronic components to be drawn therein prior to circulation by a cooling fan. The first side filter is supported by the inlet filter support structure. The first side filter is disposed below one of the sidewalls and disposed at an angle relative to the one of the sidewalls. The second side filter is supported by the inlet filter support structure. The second side filter is disposed below an opposing one of the sidewalls and disposed at the angle relative to the opposing one of the sidewalls.

20 Claims, 7 Drawing Sheets

(56) References Cited

U.S. PATENT DOCUMENTS

| | | | | |
|---|---|---|---|---|
| 8,375,849 | B2 * | 2/2013 | Sajjad | F24C 15/006 126/193 |
| 2011/0049124 | A1 | 3/2011 | Crayfourd | |

* cited by examiner

APPARATUS AND SYSTEM FOR AN OVEN SUPPORT STRUCTURE AND AIR FILTRATION ASSEMBLY

CROSS REFERENCE TO RELATED APPLICATIONS

This application claims priority to U.S. application No. 62/427,976 filed Nov. 30, 2016, the entire contents of which are hereby incorporated by reference in its entirety.

TECHNICAL FIELD

Example embodiments generally relate to ovens and, more particularly, relate to an oven that uses radio frequency (RF) heating provided by solid state electronic components and structures for effectively cooling of those components.

BACKGROUND

Combination ovens that are capable of cooking using more than one heating source (e.g., convection, steam, microwave, etc.) have been in use for decades. Each cooking source comes with its own distinct set of characteristics. Thus, a combination oven can typically leverage the advantages of each different cooking source to attempt to provide a cooking process that is improved in terms of time and/or quality.

In some cases, microwave cooking may be faster than convection or other types of cooking. Thus, microwave cooking may be employed to speed up the cooking process. However, a microwave typically cannot be used to cook some foods and also cannot brown foods. Given that browning may add certain desirable characteristics in relation to taste and appearance, it may be necessary to employ another cooking method in addition to microwave cooking in order to achieve browning. In some cases, the application of heat for purposes of browning may involve the use of heated airflow provided within the oven cavity to deliver heat to a surface of the food product.

However, even by employing a combination of microwave and airflow, the limitations of conventional microwave cooking relative to penetration of the food product may still render the combination less than ideal. Moreover, a typical microwave is somewhat indiscriminate or uncontrollable in the way it applies energy to the food product. Thus, it may be desirable to provide further improvements to the ability of an operator to achieve a superior cooking result. However, providing an oven with improved capabilities relative to cooking food with a combination of controllable RF energy and convection energy may require the structures and operations of the oven to be substantially redesigned or reconsidered.

BRIEF SUMMARY OF SOME EXAMPLES

Some example embodiments may therefore provide improved structures and/or systems for applying heat to the food product in the oven. Moreover, such improvements may necessitate new arrangements for supporting or operating such structures or systems. In particular, for an oven that uses solid state components, instead of a magnetron, to generate RF energy, the cooling of the solid state components may be important. Example embodiments may provide improved capabilities for providing such cooling, and for keeping oven internals (and components therein) clean and well maintained.

In an example embodiment, an oven is provided. The oven may include an oven body having sidewalls that extend substantially perpendicular to a surface on which the oven is supported, a cooking chamber disposed in the oven body and configured to receive a food product, an RF heating system configured to provide RF energy into the cooking chamber using solid state electronic components, and an air circulation system configured to provide air for cooling the solid state electronic components. The air circulation system may include an inlet filter support structure through which cooling air for cooling the solid state electronic components is drawn prior to circulation by a cooling fan. The inlet filter support structure may support at least a first side filter disposed below one of the sidewalls and disposed at an angle relative to the one of the sidewalls, and a second side filter disposed below an opposing one of the sidewalls and disposed at the angle relative to the opposing one of the sidewalls.

In an example embodiment, air circulation system is provided. The air circulation system includes an inlet filter support structure, a first side filter and a second side filter. The air circulation system is for an oven that has a cooking chamber configured to receive a food product and an RF heating system configured to provide RF energy into the cooking chamber using solid state electronic components. The air circulation system is configured to provide air for cooling the solid state electronic components. The inlet filter support structure enables cooling air for cooling the solid state electronic components to be drawn therein prior to circulation by a cooling fan. The first side filter is supported by the inlet filter support structure. The first side filter is disposed below one of the sidewalls and disposed at an angle relative to the one of the sidewalls. The second side filter is supported by the inlet filter support structure. The second side filter is disposed below an opposing one of the sidewalls and disposed at the angle relative to the opposing one of the sidewalls.

Some example embodiments may improve the cooking performance or operator experience when cooking with an oven employing an example embodiment.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Figure 1:
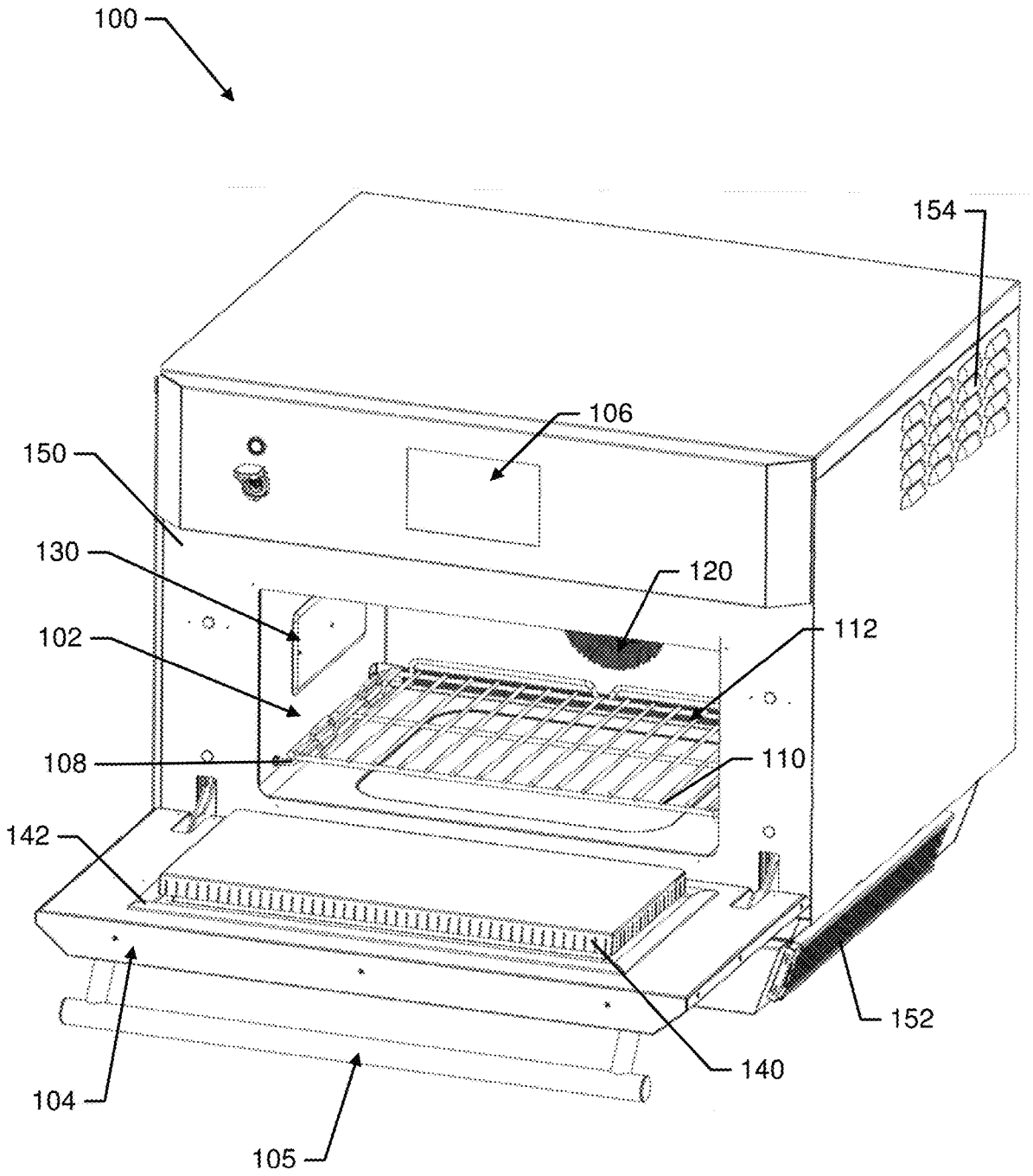
FIG. 1 illustrates a perspective view of an oven capable of employing at least two energy sources according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

Some example embodiments may improve the cooking performance of an oven and/or may improve the operator experience of individuals employing an example embodiment. In this regard, the oven may cook food relatively quickly and uniformly, based on the application of RF energy under the instruction of control electronics that are effectively cooled by structures and systems of example embodiments. The structures and systems used to cool the control electronics may manage the heat load generated by the oven, but may also do so in a way that keeps the oven internal spaces clean, or at least leaves places that are easy to clean more susceptible to accumulation of dust and debris than those locations that are difficult to clean and have sensitive components therein. Example embodiments may further employ an inlet array for the cooling system that provides a set of filters that are relatively easy to use and clean. The filters are strategically placed to maximize utility both in a normal kitchen environment and for cleanability.

FIG. 1 illustrates a perspective view of an oven 100 according to an example embodiment. As shown in FIG. 1, the oven 100 may include a cooking chamber 102 into which a food product may be placed for the application of heat by any of at least two energy sources that may be employed by the oven 100. The cooking chamber 102 may include a door 104 and an interface panel 106, which may sit proximate to the door 104 when the door 104 is closed. The door 104 may be operable via handle 105, which may extend across the front of the oven 100 parallel to the ground. In some cases, the interface panel 106 may be located substantially above the door 104 (as shown in FIG. 1) or alongside the door 104 in alternative embodiments. In an example embodiment, the interface panel 106 may include a touch screen display capable of providing visual indications to an operator and further capable of receiving touch inputs from the operator. The interface panel 106 may be the mechanism by which instructions are provided to the operator, and the mechanism by which feedback is provided to the operator regarding cooking process status, options and/or the like.

In some embodiments, the oven 100 may include multiple racks or may include rack (or pan) supports 108 or guide slots in order to facilitate the insertion of one or more racks 110 or pans holding food product that is to be cooked. In an example embodiment, air delivery orifices 112 may be positioned proximate to the rack supports 108 (e.g., just below a level of the rack supports in one embodiment) to enable heated air to be forced into the cooking chamber 102 via a heated-air circulation fan (not shown in FIG. 1). The heated-air circulation fan may draw air in from the cooking chamber 102 via a chamber outlet port 120 disposed at a back or rear wall (i.e., a wall opposite the door 104) of the cooking chamber 102. Air may be circulated from the chamber outlet port 120 back into the cooking chamber 102 via the air delivery orifices 112. After removal from the cooking chamber 102 via the chamber outlet port 120, air may be cleaned, heated, and pushed through the system by other components prior to return of the clean, hot and speed controlled air back into the cooking chamber 102. This air circulation system, which includes the chamber outlet port 120, the air delivery orifices 112, the heated-air circulation fan, cleaning components, and all ducting therebetween, may form a first air circulation system within the oven 100.

In an example embodiment, food product placed on a pan or one of the racks 110 (or simply on a base of the cooking chamber 102 in embodiments where racks 110 are not employed) may be heated at least partially using radio frequency (RF) energy. Meanwhile, the airflow that may be provided may be heated to enable further heating or even browning to be accomplished. Of note, a metallic pan may be placed on one of the rack supports 108 or racks 110 of some example embodiments. However, the oven 100 may be configured to employ frequencies and/or mitigation strategies for detecting and/or preventing any arcing that might otherwise be generated by using RF energy with metallic components.

In an example embodiment, the RF energy may be delivered to the cooking chamber 102 via an antenna assembly 130 disposed proximate to the cooking chamber 102. In some embodiments, multiple components may be provided in the antenna assembly 130, and the components may be placed on opposing sides of the cooking chamber 102. The antenna assembly 130 may include one or more instances of a power amplifier, a launcher, waveguide and/or the like that are configured to couple RF energy into the cooking chamber 102.

The cooking chamber 102 may be configured to provide RF shielding on five sides thereof (e.g., the top, bottom, back, and right and left sides), but the door 104 may include a choke 140 to provide RF shielding for the front side. The choke 140 may therefore be configured to fit closely with the opening defined at the front side of the cooking chamber 102 to prevent leakage of RF energy out of the cooking chamber 102 when the door 104 is shut and RF energy is being applied into the cooking chamber 102 via the antenna assembly 130.

In an example embodiment, a gasket 142 may be provided to extend around the periphery of the choke 140. In this regard, the gasket 142 may be formed from a material such as wire mesh, rubber, silicon, or other such materials that may be somewhat compressible between the door 104 and a periphery of the opening into the cooking chamber 102. The gasket 142 may, in some cases, provide a substantially air tight seal. However, in other cases (e.g., where the wire mesh is employed), the gasket 142 may allow air to pass therethrough. Particularly in cases where the gasket 142 is substantially air tight, it may be desirable to provide an air cleaning system in connection with the first air circulation system described above.

The antenna assembly 130 may be configured to generate controllable RF emissions into the cooking chamber 102 using solid state components. Thus, the oven 100 may not employ any magnetrons, but instead use only solid state components for the generation and control of the RF energy applied into the cooking chamber 102. The use of solid state components may provide distinct advantages in terms of allowing the characteristics (e.g., power/energy level, phase and frequency) of the RF energy to be controlled to a greater degree than is possible using magnetrons. However, since relatively high powers are necessary to cook food, the solid state components themselves will also generate relatively high amounts of heat, which must be removed efficiently in order to keep the solid state components cool and avoid damage thereto. To cool the solid state components, the oven 100 may include a second air circulation system.

The second air circulation system may operate within an oven body 150 of the oven 100 to circulate cooling air for preventing overheating of the solid state components that power and control the application of RF energy to the cooking chamber 102. The second air circulation system may include an inlet array 152 that is formed at a bottom (or basement) portion of the oven body 150. In particular, the basement region of the oven body 150 may be a substantially hollow cavity within the oven body 150 that is disposed below the cooking chamber 102. The inlet array 152 may include multiple inlet ports that are disposed on each opposing side of the oven body 150 (e.g., right and left sides when viewing the oven 100 from the front) proximate to the basement, and also on the front of the oven body 150 proximate to the basement. Portions of the inlet array 152 that are disposed on the sides of the oven body 150 may be formed at an angle relative to the majority portion of the oven body 150 on each respective side. In this regard, the portions of the inlet array 152 that are disposed on the sides of the oven body 150 may be tapered toward each other at an angle of about twenty degrees (e.g., between ten degrees and thirty degrees). This tapering may ensure that even when the oven 100 is inserted into a space that is sized precisely wide enough to accommodate the oven body 150 (e.g., due to walls or other equipment being adjacent to the sides of the oven body 150), a space is formed proximate to the basement to permit entry of air into the inlet array 152. At the front portion of the oven body 150 proximate to the basement, the corresponding portion of the inlet array 152 may lie in the same plane as (or at least in a parallel plane to) the front of the oven 100 when the door 104 is closed. No such tapering is required to provide a passage for air entry into the inlet array 152 in the front portion of the oven body 150 since this region must remain clear to permit opening of the door 104.

From the basement, ducting may provide a path for air that enters the basement through the inlet array 152 to move upward (under influence from a cool-air circulating fan) through the oven body 150 to an attic portion inside which control electronics (e.g., the solid state components) are located. The attic portion may include various structures for ensuring that the air passing from the basement to the attic and ultimately out of the oven body 150 via outlet louvers 154 is passed proximate to the control electronics to remove heat from the control electronics. Hot air (i.e., air that has removed heat from the control electronics) is then expelled from the outlet louvers 154. In some embodiments, outlet louvers 154 may be provided at right and left sides of the oven body 150 and at the rear of the oven body 150 proximate to the attic. Placement of the inlet array 152 at the basement and the outlet louvers 154 at the attic ensures that the normal tendency of hotter air to rise will prevent recirculation of expelled air (from the outlet louvers 154) back through the system by being drawn into the inlet array 152. Furthermore, the inlet array 152 is at least partially shielded from any direct communication path from the outlet louvers 154 by virtue of the fact that, at the oven sides (which include both portions of the inlet array 152 and outlet louvers 154), the shape of the basement is such that the tapering of the inlet array 152 is provided on walls that are also slightly inset to create an overhang 158 that blocks any air path between inlet and outlet. As such, air drawn into the inlet array 152 can reliably be expected to be air at ambient room temperature, and not recycled, expelled cooling air.

Figure 2:
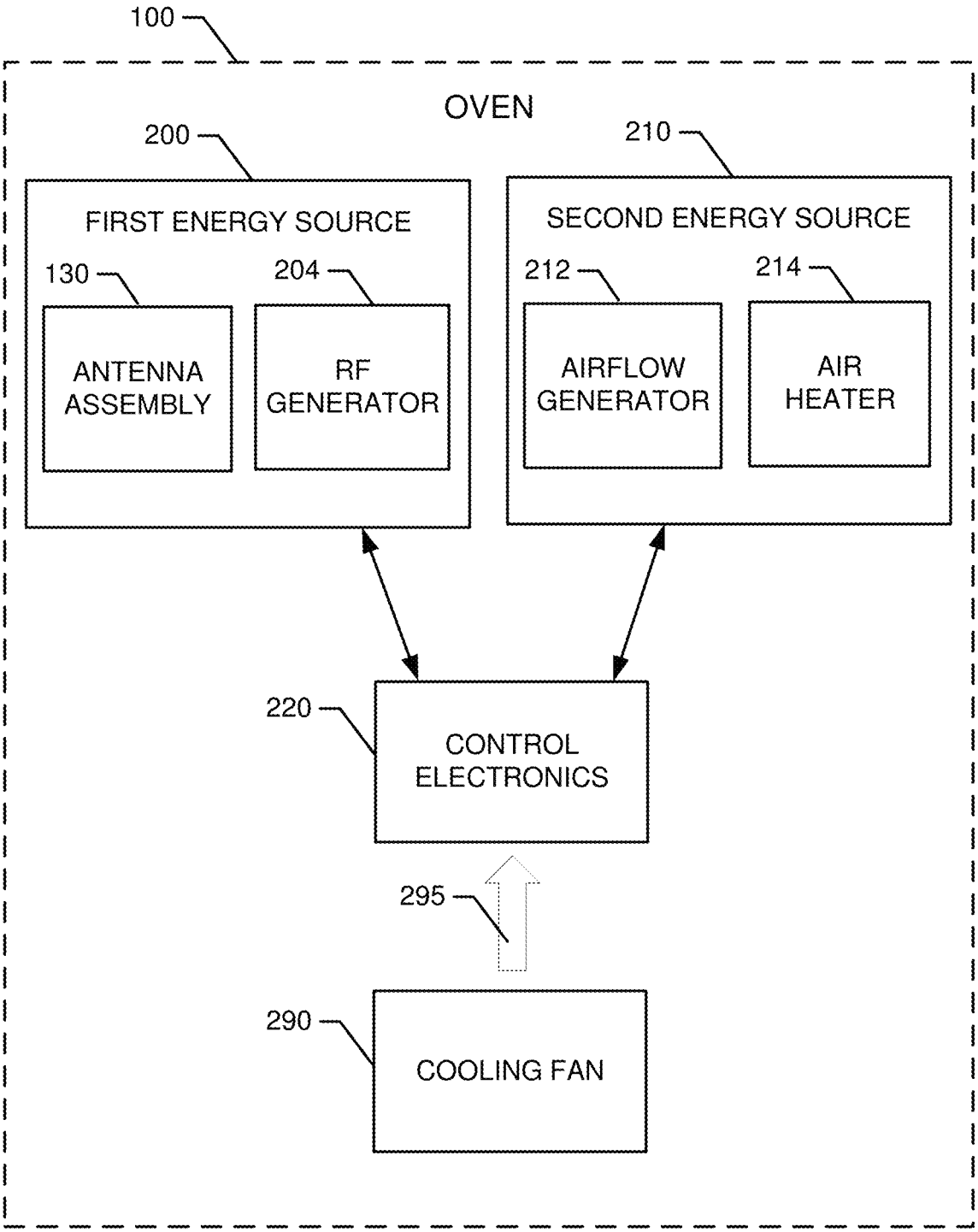
FIG. 2 illustrates a functional block diagram of the oven of FIG. 1 according to an example embodiment.

FIG. 2 illustrates a functional block diagram of the oven 100 according to an example embodiment. As shown in FIG. 2, the oven 100 may include at least a first energy source 200 and a second energy source 210. The first and second energy sources 200 and 210 may each correspond to respective different cooking methods. In some embodiments, the first and second energy sources 200 and 210 may be an RF heating source and a convective heating source, respectively. However, it should be appreciated that additional or alternative energy sources may also be provided in some embodiments. Moreover, some example embodiments could be practiced in the context of an oven that includes only a single energy source (e.g., the second energy source 210). As such, example embodiments could be practiced on otherwise conventional ovens that apply heat using, for example, gas or electric power for heating.

As mentioned above, the first energy source 200 may be an RF energy source (or RF heating source) configured to generate relatively broad spectrum RF energy or a specific narrow band, phase controlled energy source to cook food product placed in the cooking chamber 102 of the oven 100. Thus, for example, the first energy source 200 may include the antenna assembly 130 and an RF generator 204. The RF generator 204 of one example embodiment may be configured to generate RF energy at selected levels and with selected frequencies and phases. In some cases, the frequencies may be selected over a range of about 6 MHz to 246 GHz. However, other RF energy bands may be employed in some cases. In some examples, frequencies may be selected from the ISM bands for application by the RF generator 204.

In some cases, the antenna assembly 130 may be configured to transmit the RF energy into the cooking chamber 102 and receive feedback to indicate absorption levels of respective different frequencies in the food product. The absorption levels may then be used to control the generation of RF energy to provide balanced cooking of the food product. Feedback indicative of absorption levels is not necessarily employed in all embodiments however. For example, some embodiments may employ algorithms for selecting frequency and phase based on pre-determined strategies identified for particular combinations of selected cook times, power levels, food types, recipes and/or the like. In some embodiments, the antenna assembly 130 may include multiple antennas, waveguides, launchers, and RF transparent coverings that provide an interface between the antenna assembly 130 and the cooking chamber 102. Thus, for example, four waveguides may be provided and, in some cases, each waveguide may receive RF energy generated by its own respective power module or power amplifier of the RF generator 204 operating under the control of control electronics 220. In an alternative embodiment, a single multiplexed generator may be employed to deliver different energy into each waveguide or to pairs of waveguides to provide energy into the cooking chamber 102.

In an example embodiment, the second energy source 210 may be an energy source capable of inducing browning and/or convective heating of the food product. Thus, for example, the second energy source 210 may a convection heating system including an airflow generator 212 and an air heater 214. The airflow generator 212 may be embodied as or include the heated-air circulation fan or another device capable of driving airflow through the cooking chamber 102 (e.g., via the air delivery orifices 112). The air heater 214 may be an electrical heating element or other type of heater that heats air to be driven toward the food product by the airflow generator 212. Both the temperature of the air and the speed of airflow will impact cooking times that are achieved using the second energy source 210, and more particularly using the combination of the first and second energy sources 200 and 210.

In an example embodiment, the first and second energy sources 200 and 210 may be controlled, either directly or indirectly, by the control electronics 220. The control electronics 220 may be configured to receive inputs descriptive of the selected recipe, food product and/or cooking conditions in order to provide instructions or controls to the first and second energy sources 200 and 210 to control the cooking process. In some embodiments, the control electronics 220 may be configured to receive static and/or dynamic inputs regarding the food product and/or cooking conditions. Dynamic inputs may include feedback data regarding phase and frequency of the RF energy applied to the cooking chamber 102. In some cases, dynamic inputs may include adjustments made by the operator during the cooking process. The static inputs may include parameters that are input by the operator as initial conditions. For example, the static inputs may include a description of the food type, initial state or temperature, final desired state or temperature, a number and/or size of portions to be cooked, a location of the item to be cooked (e.g., when multiple trays or levels are employed), a selection of a recipe (e.g., defining a series of cooking steps) and/or the like.

In some embodiments, the control electronics 220 may be configured to also provide instructions or controls to the airflow generator 212 and/or the air heater 214 to control airflow through the cooking chamber 102. However, rather than simply relying upon the control of the airflow generator 212 to impact characteristics of airflow in the cooking chamber 102, some example embodiments may further employ the first energy source 200 to also apply energy for cooking the food product so that a balance or management of the amount of energy applied by each of the sources is managed by the control electronics 220.

In an example embodiment, the control electronics 220 may be configured to access algorithms and/or data tables that define RF cooking parameters used to drive the RF generator 204 to generate RF energy at corresponding levels, phases and/or frequencies for corresponding times determined by the algorithms or data tables based on initial condition information descriptive of the food product and/or based on recipes defining sequences of cooking steps. As such, the control electronics 220 may be configured to employ RF cooking as a primary energy source for cooking the food product, while the convective heat application is a secondary energy source for browning and faster cooking. However, other energy sources (e.g., tertiary or other energy sources) may also be employed in the cooking process.

In some cases, cooking signatures, programs or recipes may be provided to define the cooking parameters to be employed for each of multiple potential cooking stages or steps that may be defined for the food product and the control electronics 220 may be configured to access and/or execute the cooking signatures, programs or recipes (all of which may generally be referred to herein as recipes). In some embodiments, the control electronics 220 may be configured to determine which recipe to execute based on inputs provided by the user except to the extent that dynamic inputs (i.e., changes to cooking parameters while a program is already being executed) are provided. In an example embodiment, an input to the control electronics 220 may also include browning instructions. In this regard, for example, the browning instructions may include instructions regarding the air speed, air temperature and/or time of application of a set air speed and temperature combination (e.g., start and stop times for certain speed and heating combinations). The browning instructions may be provided via a user interface accessible to the operator, or may be part of the cooking signatures, programs or recipes.

As discussed above, the first air circulation system may be configured to drive heated air through the cooking chamber 102 to maintain a steady cooking temperature within the cooking chamber 102. Meanwhile, the second air circulation system may cool the control electronics 220. The first and second air circulation systems may be isolated from each other. However, each respective system generally uses differential pressures (e.g., created by fans) within various compartments formed in the respective systems to drive the corresponding air flows needed for each system. While the airflow of the first air circulation system is aimed at heating food in the cooking chamber 102, the airflow of the second air circulation system is aimed at cooling the control electronics 220. As such, cooling fan 290 provides cooling air 295 to the control electronics 220, as shown in FIG. 2.

The structures that form the air cooling pathways via which the cooling fan 290 cools the control electronics 220 may be designed to provide efficient delivery of the cooling air 295 to the control electronics 220, but also minimize fouling issues or dust/debris buildup in sensitive areas of the oven 100, or areas that are difficult to access and/or clean. Meanwhile, the structures that form the air cooling pathways may also be designed to maximize the ability to access and clean the areas that are more susceptible to dust/debris buildup. Furthermore, the structures that form the air cooling pathways via which the cooling fan 290 cools the control electronics 220 may be designed to strategically employ various natural phenomena to further facilitate efficient and effective operation of the second air circulation system. In this regard, for example, the tendency of hot air to rise, and the management of high pressure and low pressure zones necessarily created by the operation of fans within the system may each be employed strategically by the design and placement of various structures to keep certain areas that are hard to access relatively clean and other areas that are otherwise relatively easy to access more likely to be places where cleaning is needed.

Figure 3:
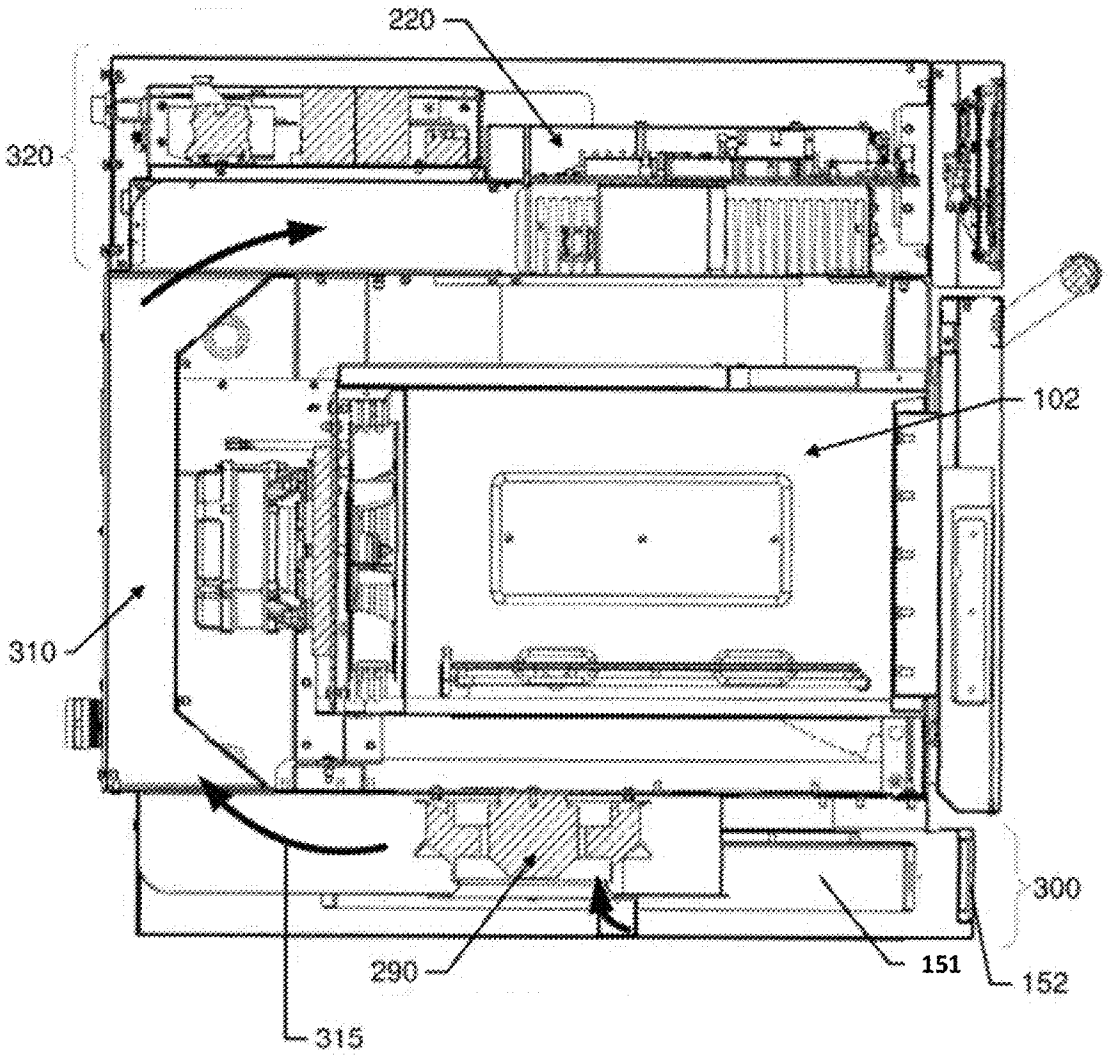
FIG. 3 shows a cross sectional view of the oven from a plane passing from the front to the back of the oven according to an example embodiment.
Figure 4:
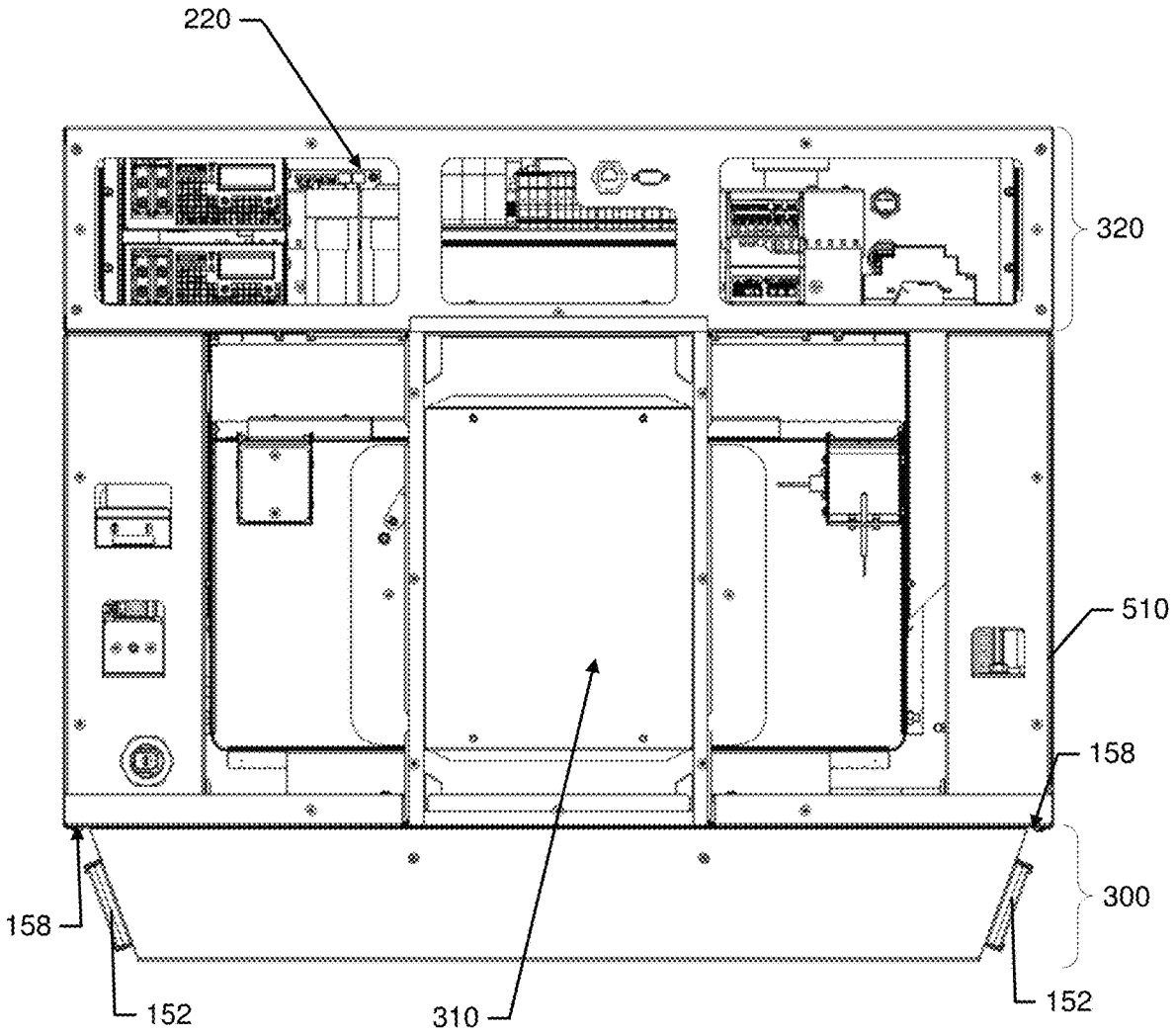
FIG. 4 is a back view of the oven with body panels removed to show various portions of a cooling air circulation system in accordance with an example embodiment.

Some example embodiments may also employ a filtering system as part of the inlet array 152 in order to keep the cooling air 295 relatively clean. The filtering system is strategically placed and structured to maximize cleanability and the ability to consistently draw in plenty of cooling air 295 regardless of the environmental surroundings. The strategic placement and structure of components of the filtering system will be described in connection with further descriptions of the typical flow path of the second air circulation system in reference to FIGS. 3-6. In this regard, FIG. 3 shows a cross sectional view of the oven 100 from a plane passing from the front to the back of the oven 100 to show various components of the second air circulation system and the filtering system. FIG. 4 is a back view of the oven 100 with panels of the oven body 150 removed to show various portions of the second air circulation system in accordance with an example embodiment. FIG. 5 shows various perspectives on an inlet filter support structure in accordance with an example embodiment. FIG. 6 shows various perspectives on feedback mechanisms in accordance with an example embodiment.

Referring primarily to FIGS. 3 and 4, the basement (or basement region 300) of the oven 100 is defined below the cooking chamber 102, and includes an inlet cavity 151. The basement region 300 may be embodied as an inlet filter support structure, inside which the inlet cavity 151 may be provided. The inlet cavity 151 is generally forced to a relatively low pressure when the cooling fan 290 is in operation. The cooling fan 290 may be disposed in or proximate to the basement region 300 to draw air therein through the inlet array 152. From the basement region 300, air may be forced (e.g., via the cooling fan 290) upward through a riser duct 151 and into an attic (or attic region 320) disposed above the cooking chamber 102. The cooling fan 290 of this example may be a centrifugal fan that operates to keep the riser duct 151 and attic region 320 at a higher pressure than ambient pressure, while the basement region 300 is at a lower pressure than ambient pressure to draw air into the basement region 300 through the inlet array 152 as shown in FIG. 4.

Referring still to FIGS. 3 and 4, during operation, air is drawn into the inlet cavity 151 through the inlet array 152 and is further drawn into the cooling fan 290 before being forced radially outward (as shown by arrow 315) away from the cooling fan 290 to the riser duct 151 (e.g., a chimney) that extends from the basement region 300 to the attic (or attic region 320) to turn air upward (as shown by arrow 315). Air is forced upward through the riser duct 151 into the attic region 340 where components of the control electronics 220 are disposed. The air then cools the components of the control electronics 220 before exiting the oven body 150 via the outlet louvers 154 (see FIG. 1).

Figure 5A:
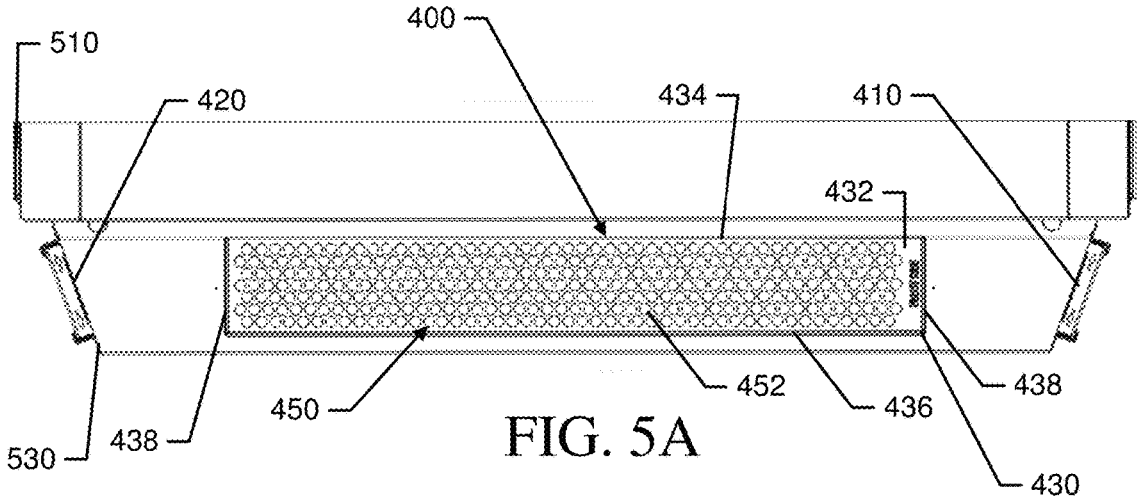
FIG. 5A is front view of a lower portion of the oven showing filters in an installed position relative to their respective filter receiver assemblies in accordance with an example embodiment.
Figure 5B:
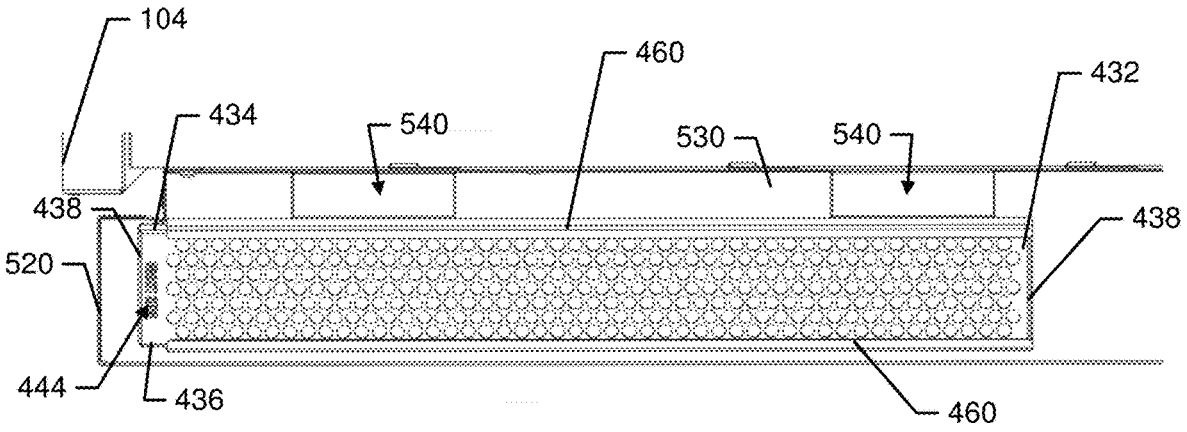
FIG. 5B illustrates a side view of the lower portion of the oven including a closer view of a first side filter in accordance with an example embodiment.
Figure 5C:
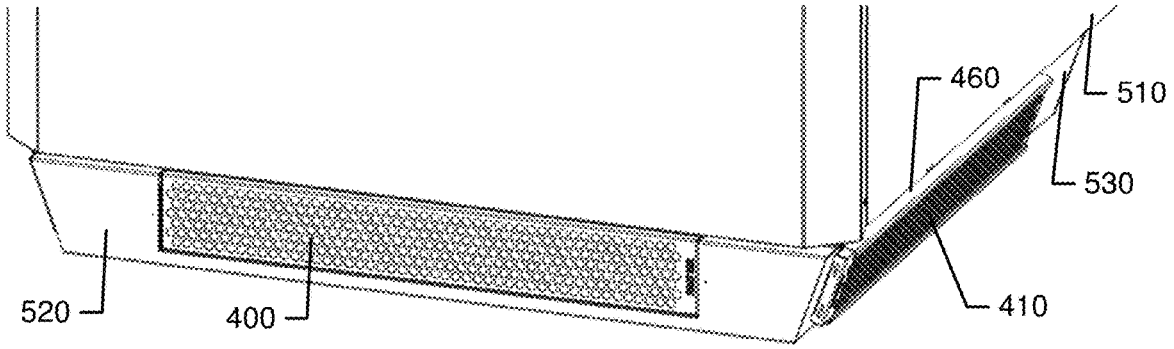
FIG. 5C illustrates a perspective view of the lower portion of the oven showing both the first side filter and the front filter in the installed position according to an example embodiment.
Figure 5D:
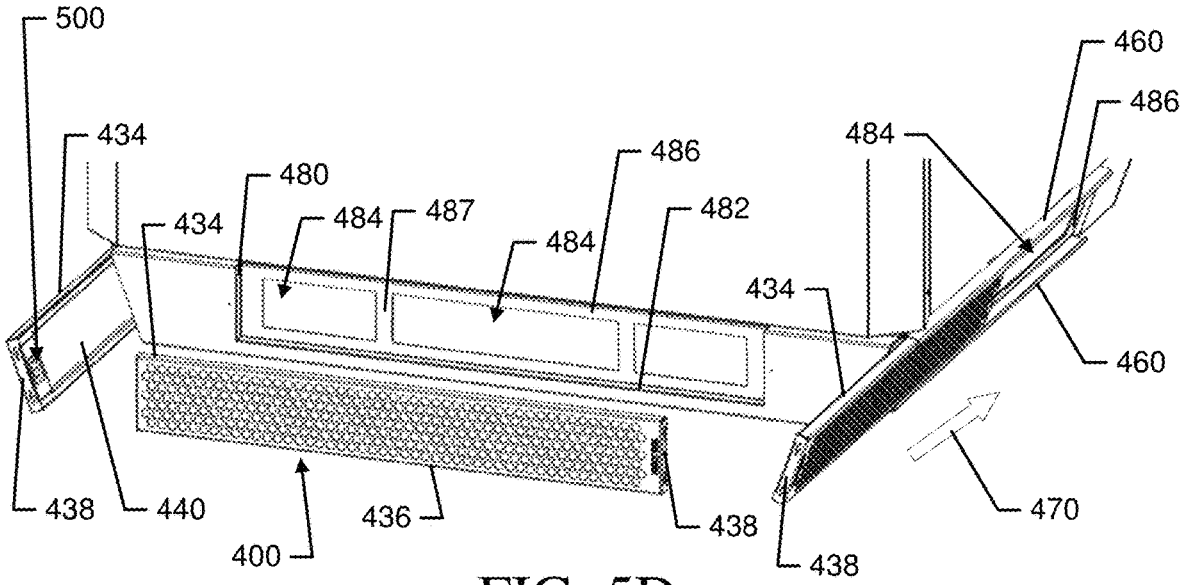
FIG. 5D illustrates a perspective view of the lower portion of the oven with the front filter removed, and the first and second side filters partially removed according to an example embodiment.

FIG. 5, which is defined by FIGS. 5A, 5B, 5C and 5D, shows various perspectives on components of the input array 152 in accordance with an example embodiment. The inlet array 152 includes a plurality of filters and a corresponding plurality of filter receiver assemblies, which are shown in FIG. 5. In this regard, FIG. 5A is front view of the lower portion of the oven 100 showing the filters, which include a front filter 400 and a first side filter 410 and second side filter 410, in an installed position relative to their respective filter receiver assemblies. Meanwhile, FIG. 5B illustrates a side view of the lower portion of the oven 100 including a closer view of the first side filter 410 in accordance with an example embodiment. FIG. 5C illustrates a perspective view of the lower portion of the oven 100 showing both the first side filter 410 and the front filter in the installed position according to an example embodiment. FIG. 5D illustrates the same perspective as FIG. 5C, but shows the front filter 400 removed, and the first and second side filters 410 and 420 partially removed.

Referring to FIGS. 5A to 5D, each of the filters (e.g., the front filter 400, and the first and second side filters 410 and 420) may include a filter frame 430 defined by a front face 432, a top face 434, a bottom face 436, end faces 438, and a back face 440. The front face 432 and the back face 440 of each of the filters may mirror each other, and may be substantially rectangular in shape. Similarly, the top face 434 and the bottom face 436 of each of the filters may mirror each other, and may be substantially rectangular in shape. Additionally, the end faces 438 may mirror each other, and may be substantially rectangular in shape. Thus, the filters may each be three dimensional rectangular structures whose front and back faces 432 and 440 are much larger than the other faces to create a relatively long length dimension, a much shorter height dimension, and a relatively thin width dimension.

In an example embodiment, each front face 432 may include a side indicator 444 that tells the user which side is the front face 432 to ensure that the filters are oriented properly when installed. Each front face 432 is also characterized by including a plurality of relatively equidistantly spaced apart orifices 450. The orifices 450 provide access to filter material 452 that is disposed between the front face 432 and the back face 440 and may substantially fill the space therebetween.

As shown in FIGS. 5B and 5D, the top face 434 and bottom face 436 of the first and second side filters 410 and 420 are substantially covered when the first and second side filters 410 and 420 are inserted into receiving tracks 460 of the filter receiver assembly. In this regard, the receiving tracks 460 extend substantially perpendicularly away from the angled surface of the sidewalls of the basement region 300 before bending about ninety degrees to contact the front face 432. As such, the top and bottom portions of the receiving tracks 460 are spaced apart from each other by a distance slightly larger than a height of the front face 432. The bend in each of the receiving tracks 460 occurs at a distance slightly larger than a width dimension of the top and bottom faces 434 and 436, respectively. Thus, the top and bottom faces 434 and 436 are in slidable contact with the receiving tracks 460 during insertion of the first and second side filter 410 and 42 into their respective filter receiver assemblies by motion in the direction of arrow 470 shown in FIG. 5D.

As shown particularly in FIGS. 5C and 5D, the front filter 400 is retained differently than the way the first and second side filters 410 and 420 are retained. In this regard, while the first and second side filters 410 and 420 are inserted via slidable contact with the receiving tracks 460, the front filter 400 is directly inserted into its corresponding filter receiver assembly. The filter receiver assembly of the front filter 400 is defined by sidewalls 480 that lie substantially parallel to and facing the end faces 438 of the front filter 400, and a bottom wall 482 that lies substantially parallel to and faces the bottom face 436 of the front filter 400. There is no wall facing or adjacent to the top face 434 of the front filter 400 in this example to allow the top face 434 to be grasped to rotate the front filter 400 out of the filter receiver assembly for removal. A gap may be provided between the door 104 of the oven 100 and the top face 434 to enable the top face 434 to be grasped regardless of the position of the door 104.

As shown in FIG. 5D, the filter receiver assemblies may include backing portions 486 that lie substantially parallel to and face the back faces 440 of the filters. The backing portions 486 may surround inlet orifices 484 through which air that passes through the orifices 450 and the filter material 452 of the filters enters into the basement region 300. As shown in FIG. 5D (and FIG. 6), the backing portions 486 may correspond to and support peripheral edges of the back face 440 of each filter, but may also include reinforcement portions 487 disposed in middle regions of the inlet orifices 484 to define individual smaller inlet orifices 484 instead of one large such orifice for each of the filters.

In an example embodiment, the filter frame 430 (or portions thereof) and/or the backing portions 486 (or portions thereof) may be made of metallic material. Accordingly, one or more magnets 500 may be provided at portions of the filter frame 430 (e.g., in the back face 440) and/or in the backing portions 486 to allow magnetic coupling to facilitate retaining of the filters. In some embodiments, magnets 500 may be provided at portions of the back face 440 of the filters that are proximate to the end faces 438 to allow the magnets 500 to interact with portions of the backing portions 486 that are proximate thereto when the corresponding filters are inserted in their respective filter receiver assemblies. In some examples, the filter frame 430 may be non-metallic and the magnets 510 (or metallic portions) may be affixed to the filter frame 430.

When the filters are installed, each of the filters may be inset relative to the lateral and front edges of the oven 100. In this regard, for example, it can be appreciated that the front face 432 of the front filter 400 will be closer to a line passing through a center of the oven 100 from top to bottom (i.e., the oven centerline) than the front of the oven (or door 104). All portions of the front filter 400 are therefore closer to the oven centerline than the front of the oven or door 104. Similarly, all portions of the first and second side filters 410 and 420 are closer to the oven centerline than sidewalls 510 of the oven 100 (see FIG. 4). However, while the front filter 400 is inset relative to the front of the oven 100 or door 104 and substantially parallel thereto, the first and second side filters 410 and 420 are inset relative to the sidewalls 510 of the oven 100, but also at an angle relative to the sidewalls 510 (e.g., tapered away from the sidewalls 510 from about 10 to about 40 degrees).

The inset positioning of the filters may prevent recycling of cooling air since the overhang 158 blocks any direct path for air to be recycled. However, only the first and second side filters 410 and 420 are also positioned at an angle to further facilitate the provision of space to draw air into the basement region 300 through the filters when other equipment is located adjacent to the sidewalls 510 of the oven 100. The angling of the first and second side filters 410 and 420 therefore facilitates airflow, but also allows easy access to the first and second side filters 410 and 420 in the space created below the overhang 158 by the angling so that the first and second side filters 410 and 420 can be removed, and an arm or hand can be inserted into the basement region 300 for cleaning purposes.

In some cases, while a front face 432 of the front filter 400 may be substantially parallel to and in a plane with a front face 520 of the basement region 300 (e.g., therefore being flush with the front face 520), the back face 440 of the first and second side filters 410 and 420 may be substantially parallel to and adjacent to a slanted side face 530 of the side faces of the basement region 300. Moreover, in some example embodiments, handle depressions 540 may be provided between the sidewalls 510 and a top one of the receiving tracks 460. The handle depressions 540 may be spaced apart from each other, and may extend from the overhang 158 to the top of the top one of the receiving tracks 460.

In some embodiments, the filter material 452 may be a metallic mesh that is hand or machine washable. However, in other examples, the filter material 452 could be non-woven fiber material or other substances provided to filter particulates and/or dust particles from air passing therethrough. Although the filter material 452 of some embodiments may be washable, alternative embodiments may employ disposable mesh or other filter materials.

Figure 6A:
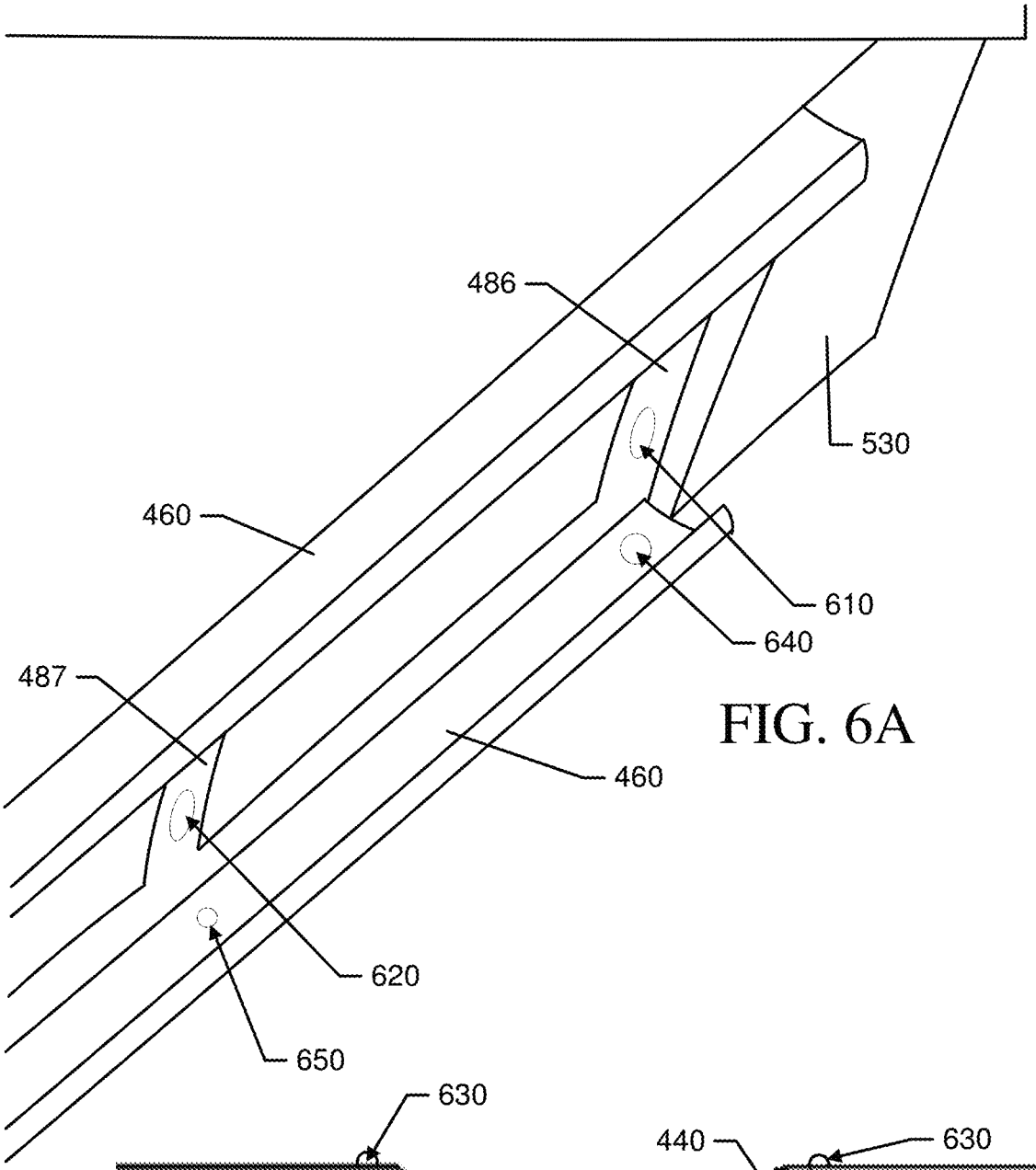
FIG. 6A illustrates a perspective view of feedback mechanisms that may interact with the filters in accordance with some example embodiments.
Figure 6B:
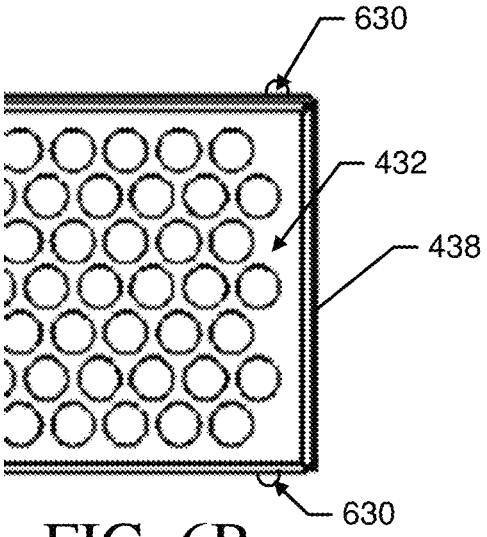
FIG. 6B illustrates a front face of one of the side filters with retractable balls provided thereon according to an example embodiment.
Figure 6C:
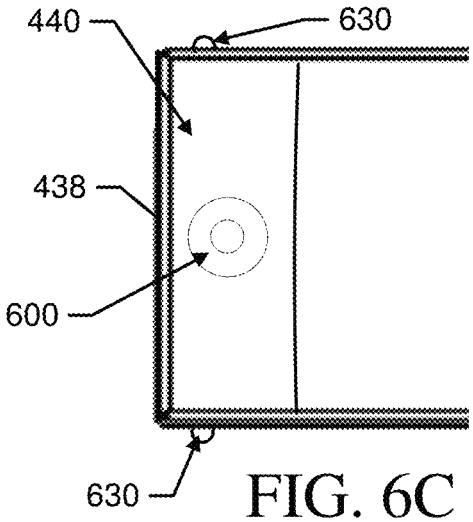
FIG. 6C illustrates a back face of one of the side filters with retractable balls and a magnet provided thereon according to an example embodiment.

In some embodiments, the filters may have feedback mechanisms provided thereon to enable the user to detect when the filters are properly installed, or a location of the filters relative to a final installed position. FIG. 6, which is defined by FIGS. 6A, 6B and 6C, illustrates examples of such feedback mechanisms. As shown in FIG. 6C, a magnet 600 may be provided on the back face 440 of the first or second side filter 410 or 420 proximate to an end face 438 thereof. The magnet 600 may interact with a corresponding magnetic feedback member (which may be either metallic or magnetic itself) disposed at a position along the receiving tracks 460 that is indicative of the relative position of the filter in the receiving tracks 460. For example, a first magnetic feedback member 610 may be provided to coincide with the magnet 600 when the filter is fully installed or seated within the receiving tracks 460. Meanwhile, the interaction of the magnet 600 with a second magnetic feedback member 620 disposed at the reinforcement member 487 may indicate that the filter has traveled approximately half way down the receiving tracks 460. In some cases, the feedback provided by the second magnetic feedback member 620 may be less strong than the feedback provided by the first magnetic feedback member 610 to further allow differentiation therebetween.

In addition to magnetic feedback, or as an alternative thereto, haptic feedback may be provided. In this regard, for example, a retractable (or partially retractable) ball 630 may be positioned on a top face 434 and/or bottom face 436 of the filter (e.g., proximate to the end face 438 or at some other known position). One or more seating depressions may be provided as haptic feedback members along the top and/or bottom receiving tracks 460. Thus, for example, the retractable ball 630 may snap into a first seating depression 640 (or haptic feedback member) when the filter is fully installed or seated. Meanwhile, the retractable ball 630 may snap into a second seating depression 650 (or haptic feedback member) when the filter is approximately half way (or some other predetermined location) along the receiving tracks 460 to indicate a corresponding fraction of the way toward being fully installed or seated. In some examples, the first and second seating depressions 640 and 650 could be the same size to provide substantially the same haptic feedback in either case. However, in other examples, the second seating depression 650 may be smaller or shallower than the first seating depression 640 to allow differentiation between the two corresponding locations based on haptic feedback. Other structures for providing haptic feedback such as protrusions that engage ridges, or a wall to stop movement at full seating of the filters may also or alternatively be employed in some cases.

As can be appreciated from the description above, the cooling fan 290 may draw air into the basement region 300, which is a low pressure region relative to ambient pressure. Thereafter, the air is transported to the attic region 320 to cool the control electronics 220. However, the structure of the basement region 300 and the filters provided at the basement region 300 make any dust/debris that should happen to collect in the filters or in the basement region 300 relatively easy to clean. Thus, the oven 100 may operate efficiently and effectively with easy maintenance and improve the user experience. With a relatively simple removal of the components forming the inlet array 152, access to the basement region 300 may be afforded to the operator to enable the operator to clean dust or debris accumulated in the basement region 300 along with cleaning of the filters of the inlet array 152 during routine maintenance or cleaning procedures. Thus, dust and debris (if any) would in any case tend to accumulate far from the control electronics 220 and in a place that is relatively easy to clean.

In an example embodiment, an oven may be provided. The oven may include an oven body having sidewalls that extend substantially perpendicular to a surface on which the oven is supported, a cooking chamber disposed in the oven body and configured to receive a food product, an RF heating system configured to provide RF energy into the cooking chamber using solid state electronic components, and an air circulation system configured to provide air for cooling the solid state electronic components. The air circulation system may include an inlet filter support structure through which cooling air for cooling the solid state electronic components is drawn prior to circulation by a cooling fan. The inlet filter support structure may support at least a first side filter disposed below one of the sidewalls and disposed at an angle relative to the one of the sidewalls, and a second side filter disposed below an opposing one of the sidewalls and disposed at the angle relative to the opposing one of the sidewalls.

In some embodiments, additional optional features may be included or the features described above may be modified or augmented. Each of the additional features, modification or augmentations may be practiced in combination with the features above and/or in combination with each other. Thus, some, all or none of the additional features, modification or augmentations may be utilized in some embodiments. For example, in some cases, the angle may be between 10 degrees and 40 degrees. In an example embodiment, the first and second side filters may be further inset relative to the sidewalls and separated from the sidewalls by an overhang. In some cases, the inlet filter support structure may further support a front filter disposed below a door of the oven. In such an example, when the front filter is installed, a front face of the front filter may be substantially parallel to and in a plane with a front face of the inlet filter support structure. When the first and second side filters are installed, a back face of each of the first and second side filters may lie parallel to and proximate to a slanted side face opposing sides of the inlet filter support structure. In an example embodiment, the front filter and the first and second side filters may each be at least partially retained in an installed position by magnets. In an example embodiment, the first and second side filters may be installed into receiving tracks that extend in a direction substantially parallel to each other and substantially perpendicular to a direction of longitudinal extension of the front filter. In some cases, the first and second side filters may include feedback mechanisms configured to indicate a relative location of the first and second side filters relative to the receiving tracks. In an example embodiment, the feedback mechanisms may provide different feedback for corresponding different relative locations. In some embodiments, the feedback mechanisms may be magnetic or haptic feedback mechanisms.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. An oven comprising:

an oven body having sidewalls that extend substantially perpendicular to a surface on which the oven is supported;

a cooking chamber disposed in the oven body and configured to receive a food product;

a radio frequency (RF) heating system configured to provide RF energy into the cooking chamber using solid state electronic components; and an air circulation system configured to provide air for cooling the solid state electronic components, wherein the air circulation system comprises an inlet filter support structure through which cooling air for cooling the solid state electronic components is drawn prior to circulation by a cooling fan, wherein the inlet filter support structure supports at least a first side filter disposed below one of the sidewalls and disposed at an angle relative to the one of the sidewalls, and a second side filter disposed below an opposing one of the sidewalls and disposed at the angle relative to the opposing one of the sidewalls, wherein the inlet filter support structure further supports a front filter disposed below a door of the oven, wherein, when the front filter is installed, a front face of the front filter is substantially parallel to and in a plane with a front face of the inlet filter support structure, and wherein, when the first and second side filters are installed, a back face of each of the first and second side filters lies parallel to and proximate to a slanted side face on opposing sides of the inlet filter support structure.

2. The oven of claim 1, wherein the angle is between 10 degrees and 40 degrees.

3. The oven of claim 2, wherein the first and second side filters are further inset relative to the sidewalls and separated from the sidewalls by an overhang.

4. The oven of claim 1, wherein the front filter and the first and second side filters are each at least partially retained in an installed position by magnets.

5. The oven of claim 1, wherein the first and second side filters are installed into receiving tracks that extend in a direction substantially parallel to each other and substantially perpendicular to a direction of an extension of the front filter.

6. The oven of claim 5, wherein the first and second side filters include feedback mechanisms configured to indicate a relative location of the first and second side filters relative to the receiving tracks.

7. The oven of claim 6, wherein the feedback mechanisms provide different feedback for corresponding different relative locations.

8. The oven of claim 6, wherein the feedback mechanisms are magnetic or haptic feedback mechanisms.

9. An air circulation system for an oven, the oven comprising a body having sidewalls, a cooking chamber configured to receive a food product and a radio frequency (RF) heating system configured to provide RF energy into the cooking chamber using solid state electronic components, the air circulation system being configured to provide air for cooling the solid state electronic components, the air circulation system comprising:

an inlet filter support structure through which cooling air for cooling the solid state electronic components is drawn prior to circulation by a cooling fan;

a first side filter supported by the inlet filter support structure, the first side filter being disposed below one of the sidewalls and disposed at an angle relative to the one of the sidewalls, and a second side filter supported by the inlet filter support structure, the second side filter being disposed below an opposing one of the sidewalls and disposed at an angle relative to the opposing one of the sidewalls, wherein the inlet filter support structure supports a front filter disposed below a door of the oven, wherein, when the front filter is installed, a front face of the front filter is substantially parallel to and in a plane with a front face of the inlet filter support structure, and wherein, when the first and second side filters are installed, a back face of each of the first and second side filters lies parallel to and proximate to a slanted side face on opposing sides of the inlet filter support structure.

10. The air circulation system of claim 9, wherein the angle is between 10 degrees and 40 degrees.

11. The air circulation system of claim 10, wherein the first and second side filters are inset relative to the sidewalls and separated from the sidewalls by an overhang.

12. The air circulation system of claim 9, wherein the front filter and the first and second side filters are each at least partially retained in an installed position by magnets.

13. The air circulation system of claim 9, wherein the first and second side filters are installed into receiving tracks that extend in a direction substantially parallel to each other and substantially perpendicular to a direction of an extension of the front filter.

14. The air circulation system of claim 13, wherein the first and second side filters include feedback mechanisms configured to indicate a relative location of the first and second side filters relative to the receiving tracks.

15. The air circulation system of claim 14, wherein the feedback mechanisms provide different feedback for corresponding different relative locations.

16. The air circulation system of claim 14, wherein the feedback mechanisms are magnetic or haptic feedback mechanisms.

17. An oven comprising:

an oven body having sidewalls that extend substantially perpendicular to a surface on which the oven is supported;

a cooking chamber disposed in the oven body and configured to receive a food product;

a radio frequency (RF) heating system configured to provide RF energy into the cooking chamber using solid state electronic components; and an air circulation system configured to provide air for cooling the solid state electronic components, wherein the air circulation system comprises an inlet filter support structure through which cooling air for cooling the solid state electronic components is drawn prior to circulation by a cooling fan, wherein the inlet filter support structure supports at least a first side filter disposed below one of the sidewalls and disposed at an angle relative to the one of the sidewalls, and a second side filter disposed below an opposing one of the sidewalls and disposed at the angle relative to the opposing one of the sidewalls, wherein the inlet filter support structure further supports a front filter disposed below a door of the oven, wherein the first and second side filters are installed into receiving tracks that extend in a direction substantially parallel to each other and substantially perpendicular to a direction of an extension of the front filter, and wherein the first and second side filters include feedback mechanisms configured to indicate a relative location of the first and second side filters relative to the receiving tracks.

18. The oven of claim 17, wherein, when the front filter is installed, a front face of the front filter is substantially parallel to and in a plane with a front face of the inlet filter support structure, and wherein, when the first and second side filters are installed, a back face of each of the first and second side filters lies parallel to and proximate to a slanted side face on opposing sides of the inlet filter support structure.

19. An air circulation system for an oven, the oven comprising a body having sidewalls, a cooking chamber configured to receive a food product, and a radio frequency (RF) heating system configured to provide RF energy into the cooking chamber using solid state electronic components, the air circulation system being configured to provide air for cooling the solid state electronic components, the air circulation system comprising:

an inlet filter support structure through which cooling air for cooling the solid state electronic components is drawn prior to circulation by a cooling fan;

a first side filter supported by the inlet filter support structure, the first side filter being disposed below one of the sidewalls and disposed at an angle relative to the one of the sidewalls; and a second side filter supported by the inlet filter support structure, the second side filter being disposed below an opposing one of the sidewalls and disposed at the angle relative to the opposing one of the sidewalls, wherein the inlet filter support structure supports a front filter disposed below a door of the oven, wherein the first and second side filters are installed into receiving tracks that extend in a direction substantially parallel to each other and substantially perpendicular to a direction of an extension of the front filter, and wherein the first and second side filters include feedback mechanisms configured to indicate a relative location of the first and second side filters relative to the receiving tracks.

20. The air circulation system of claim 19, wherein, when the front filter is installed, a front face of the front filter is substantially parallel to and in a plane with a front face of the inlet filter support structure, and wherein, when the first and second side filters are installed, a back face of each of the first and second side filters lies parallel to and proximate to a slanted side face on opposing sides of the inlet filter support structure.

* * * * *